US006053468A

United States Patent [19]

Francis

[11] Patent Number: 6,053,468

[45] Date of Patent: Apr. 25, 2000

[54] FRAME SUPPORT SYSTEM

[76] Inventor: Scott A. Francis, 420 W. First St., Sandwich, Ill. 60548

[21] Appl. No.: 09/149,821

[22] Filed: Sep. 8, 1998

[51] Int. Cl.[7] ..... A47F 7/14

[52] U.S. Cl. ..... 248/475.1; 248/489; 248/493

[58] Field of Search ..... 248/475.1, 489, 248/493; 52/36.4, 38, 608, 609, 698, 730.6, 731.7

[56] References Cited

U.S. PATENT DOCUMENTS

| | | | |
|---|---|---|---|
| D. 331,007 | 11/1992 | Roick | D8/367 |
| D. 359,674 | 6/1995 | Roick | D8/367 |
| 1,342,610 | 6/1920 | Wheeler | 52/480 |
| 1,806,113 | 5/1931 | Nygaard | 52/510 |
| 3,203,142 | 8/1965 | Narmore | 248/475.1 |
| 3,294,356 | 12/1966 | Sherman | 248/476 |
| 3,636,669 | 1/1972 | Attkisson | 52/510 |
| 3,838,842 | 10/1974 | McCracken | 248/476 |
| 3,853,226 | 12/1974 | Hine et al. | 211/104 |
| 4,012,023 | 3/1977 | Melanson | 248/489 |
| 4,067,537 | 1/1978 | Pejrud | 248/476 |
| 4,069,998 | 1/1978 | Ryttig | 248/476 |
| 4,177,901 | 12/1979 | Deconinck | 248/475.1 |
| 4,222,544 | 9/1980 | Aswder | 248/495 |
| 4,228,982 | 10/1980 | Sellera | 248/475.1 |
| 4,530,482 | 7/1985 | Berinson | 248/475.1 |
| 4,542,831 | 9/1985 | Dazza | 211/90 |
| 4,549,713 | 10/1985 | Magadini | 248/495 |
| 4,591,125 | 5/1986 | Bellehumeur | 248/476 |
| 4,611,779 | 9/1986 | Leonard, Jr. | 248/476 |
| 4,645,165 | 2/1987 | Raap | 248/476 |
| 4,712,761 | 12/1987 | Wassell | 248/475.1 |
| 4,869,479 | 9/1989 | Colonel et al. | 52/480 |
| 4,973,021 | 11/1990 | Schuite | 248/495 |
| 4,989,819 | 2/1991 | Sigler | 248/476 |
| 5,029,425 | 7/1991 | Bogataj | 52/510 |
| 5,328,139 | 7/1994 | Barnes | 248/475.1 |
| 5,342,014 | 8/1994 | Wilson | 248/476 |
| 5,647,183 | 7/1997 | Counihan | 52/480 |
| 5,685,516 | 11/1997 | Simmons | 248/489 |

FOREIGN PATENT DOCUMENTS

| | | | |
|---|---|---|---|
| 197712 | 1/1978 | France | 52/510 |
| 197808 | 8/1978 | German Dem. Rep. | 52/510 |
| 324446 | 3/1970 | Sweden | 52/510 |
| 1031208 | 6/1966 | United Kingdom | 248/475.1 |
| 093025126 | 12/1993 | WIPO | 248/489 |

*Primary Examiner*—Anita M. King
*Assistant Examiner*—Debbie Short
*Attorney, Agent, or Firm*—Joseph N. Breaux

[57] ABSTRACT

A frame wall mounting system which includes an elongated wall mount block which has a plurality of nail or screw apertures for attaching the elongated mount block to a wall in a level position. A S-shaped mounting block wherein a lower portion of the "S" shaped mounting frame includes a resilient block having a number of nail or screw fitting apertures provided therethrough for mounting the "S" shape mounting frame to the back side of a picture frame or any other item to be hung from the elongated wall mount block. The resilient portion of the "S" shaped mounting frame may also be used to hand items in alignment from the elongated wall mount block if desired. The system provides a mechanism for hanging any number of pictures, limited only by the length of the elongated wall mount block, in alignment with each other and level with the floor.

1 Claim, 3 Drawing Sheets

FRAME SUPPORT SYSTEM

TECHNICAL FIELD

The present invention relates to devices and methods for picture frame supports and more particularly to devices and methods for a frame support system that comprises a wall mount elongated block member having a plurality of nail or screw apertures formed therethrough, a lower portion thereof and an upper portion featuring a rectangular shaped peak cross sectional area running along the top plain thereof and a mounting frame member having a substantially stylized "S" shape wherein the lower portion thereof includes a resilient block having a number of nail or screw fitting apertures provided therethrough. In use, the resilient portion of the "S" shaped block is screwed to the picture frame providing a attachment means for the picture frame to hang in any location along the elongated wall mount block. Any number of pictures may be hung on the same elongated wall mount block providing a means for hanging and aligning pictures along a wall.

BACKGROUND ART

There have been numerous picture hanging devices developed which provide a means for hanging picture. There has never been an invention as the present which provides an elongated wall mounting block from which numerous pictures may be hung while a stylized "S" shaped mounting block is attached to a back side of each picture frame. The system allows a user to position pictures along the elongated wall mount block and furthermore, the wall mount block assures that the pictures are aligned level with the room floor and in alignment with each other.

The prior art patents which are relevant are as follows: Wilson, U.S. Pat. No. 5,342,014; Figler, U.S. Pat. No. 4,989,819; Schuite, U.S. Pat. No. 4,973,021; Raap, U.S. Pat. No. 4,645,165; Leonard, Jr., U.S. Pat. No. 4,611,779; Bellehumeur, U.S. Pat. No. 4,591,125; Magadini, U.S. Pat. No. 4,549,713; Crowder, U.S. Pat. No. 4,222,544; Rytting, U.S. Pat. No. 4,069,998; Pejrud, U.S. Pat. No. 4,067,537; McCracken, U.S. Pat. No. 3,838,842; and Sherman, U.S. Pat. No. 3,294,356.

As can be seen from the prior art there has never been a device as the present which includes an elongated wall mount block which provides a means for hanging numerous pictures and other items if desired. The elongated wall mount block is easy to install on a wall while S-shaped stylized mounting blocks are provided for attaching to the back side of a picture which then allow the picture, or other item, to be hung from the elongated mounting block at any selected location while a stylized "S" mounting block may also not be attached to the back of the picture and used to simply hang items from as desired.

GENERAL SUMMARY DISCUSSION OF INVENTION

It is thus an object of the invention to provide a Frame Support System that is easy to install and provides a system for mounting numerous pictures in alignment with each other and which are level with the room floor.

It is a further object of the invention to provide a Frame Support System that includes an elongated wall mount block that is attachable to a wall by either screws or nails and wherein a stylized "S" shaped block is attached to a back side of a picture to be hung at a given location on the elongated block.

It is a further object of the present invention to provide stylized "S" shaped blocks which may either be attached to a back side of a picture to be hung from an elongated wall mount block or which stylized "S" shaped blocks may be used to hang a picture frame or any other object desired to be hung from a wall.

Accordingly, a Frame Support System is provided which comprises an elongated wall mount block which is positioned on a section of a wall in a room providing a straight and level mounting block for hanging pictures or any other items from the mounting block and further wherein a mounting block is provided with a stylized "S" shaped mounting block wherein a lower portion thereof includes a resilient block having a number of nail or screw fitting apertures provided therethrough for mounting a resilient block to a backside of a picture or other items to be hung. In use, the resilient portion of the "S" shaped block may also be used for hanging a picture or other item if desired.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the following description that in use, a user would mount the elongated wall mount block to a wall area where he/she wishes to hang numerous framed items such as pictures, certificates, etc. A length of the elongated wall mount block would be utilized for hanging an appropriate number of items. The length of the elongated wall mount block would be dictated by the needs of the specific task at hand. Next the user would either attach a "S" shaped mounting member to a back of a picture frame or simply secure the "S" shaped mounting members to the elongated wall mounting block as desired. The pictures or other items are then ready to hang from any desired location along the elongated wall mount block so that the pictures are hung in alignment and also level.

Figure 1:
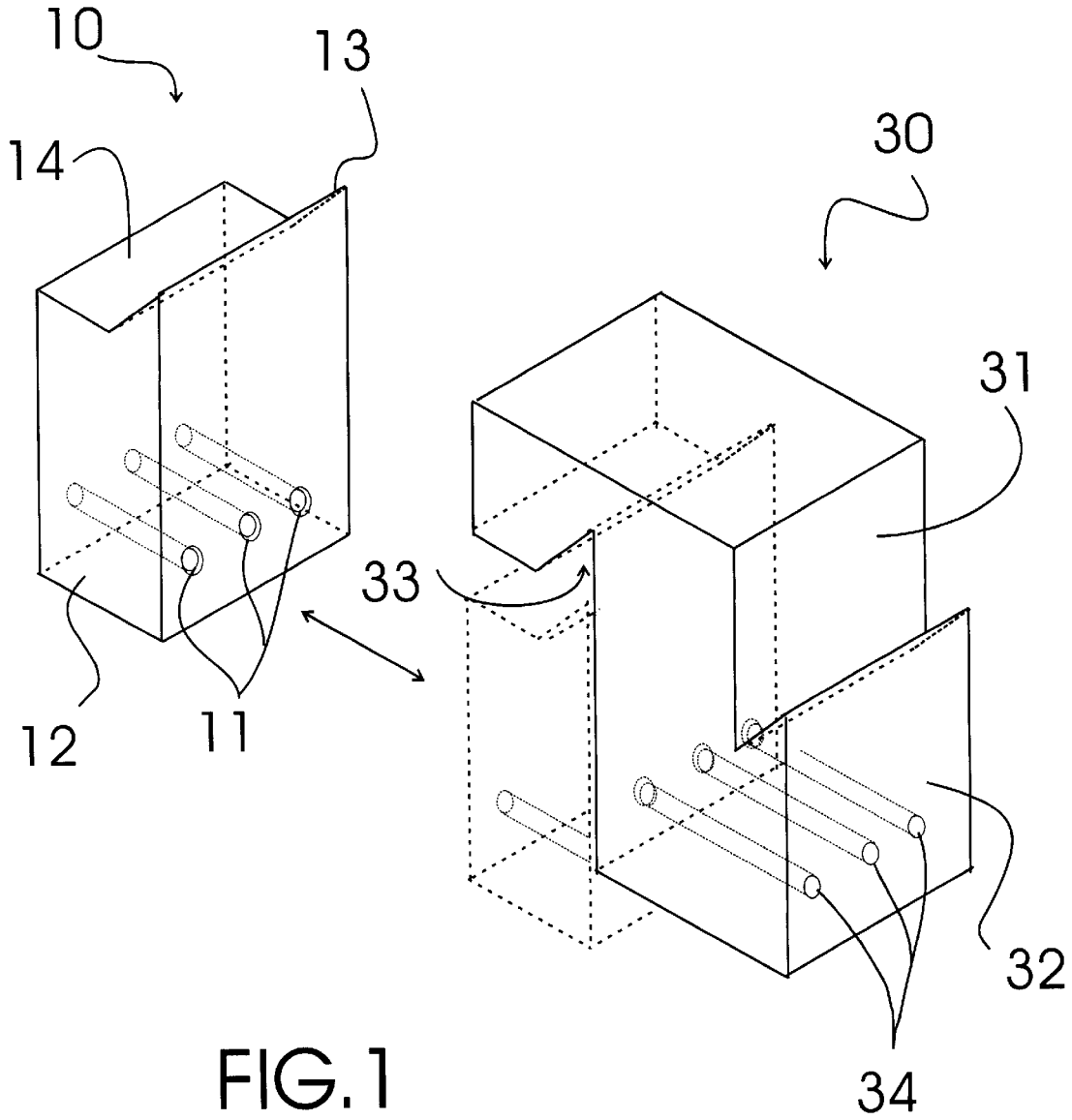
FIG. 1 is an isometric view of the elongated wall mount block and the stylized "S" shaped mounting block illustrating the interaction of the two mounting blocks.
Figure 2:
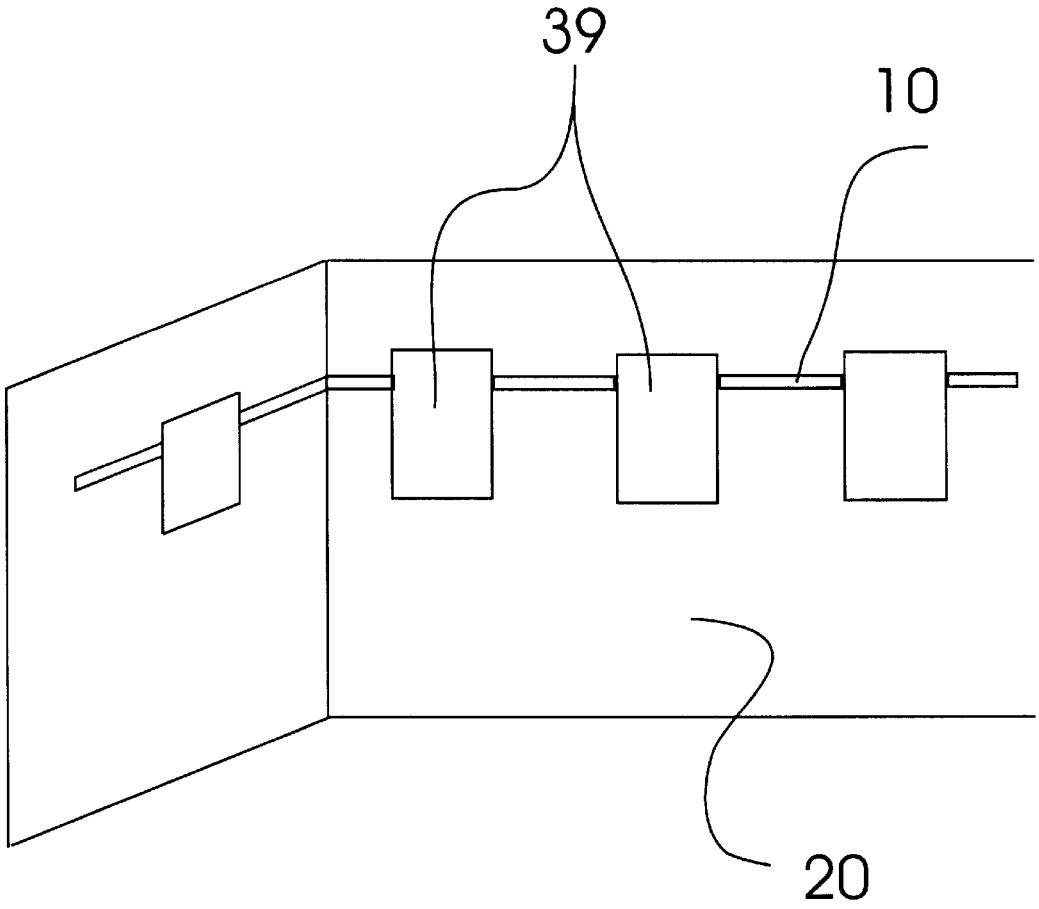
FIG. 2 is a perspective view of a room with an elongated block mounted to the wall with pictures hung in alignment and level with the room's floor.

Referring to the figures in detail FIG. 1 illustrates a short section of the elongated wall mounting block 10 with numerous mounting apertures 11 providing locations for securely attaching the elongated wall mount block to a wall as desired. FIG. 1 also illustrates a section of an "S" shaped mounting block and its relation with the elongated wall mount block. The elongated wall mount block includes a lower rectangular shape member 12 with a peak extending from a front top edge of said rectangular member and wherein said peak extends the entire length of the elongated wall mount block. Once the wall mount block is mounted to a wall, a retention area 14 is created between the wall, a top surface of the rectangular member, and a back surface of the elongated peak. The retention area 14 provides a location for placing the "S" shaped mounting block on any location along the elongated wall mount block. The elongated peak 13 provides a positive means for retaining the "S" shaped mounting block within the retention area 14. The elongated wall mount block is preferably constructed of a durable light weight material such as plastic and/or aluminum. The elongated wall mount block is illustrated in FIG. 2 mounted to a wall on an interior of a room 20. The elongated wall mount block is preferably attached to the wall utilizing screws extending through the numerous apertures 11 and furthermore the elongated wall mount block is mounted to the wall level with the room floor and/or ceiling. The length of the elongated wall mount block is determined by the number of pictures to be hung on a given wall. For example, as illustrated in FIG. 2, there are three pictures hung along a wall with some residual portion of the elongated wall mount block extending beyond the last picture. Arranging the elongated wall mount block in this configuration allows for additional picture to be hung as desired.

Figure 5:
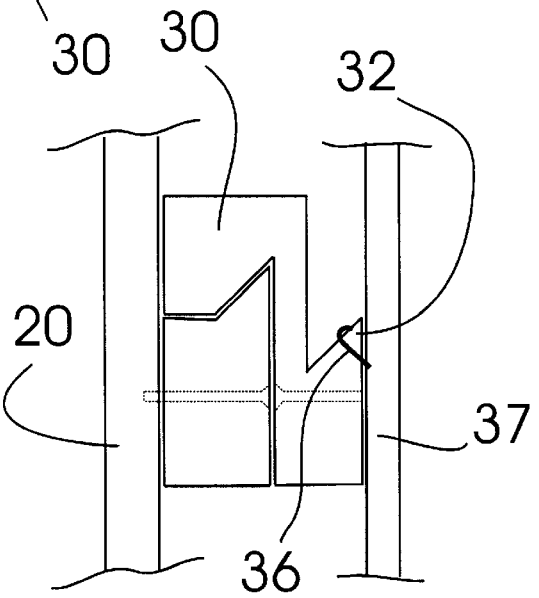
FIG. 5 is a side view of the elongated block and the stylized "S" shaped block with a picture hung from the stylized "S" shaped mounting block.

The "S" shaped mounting block 30 includes a rectangular middle member 31 with a front peak portion 32 integrally formed as an extension of the rectangular member 31. A rear retention groove 33 formed between a top back portion of the rectangular member 31 and a rectangular extension extending back an opposite indirection of the front peak 32. The retention groove 33 provides a mating location for the elongated peak 13 on the elongated wall mount block. The "S" shaped block includes numerous mounting apertures 34 extending through a lower portion of the "S" shaped mounting block and which mounting apertures provide a mounting location for screws extending through the "S" shaped mounting block and into a back surface of a picture frame desired to be hung. The inventor contemplates providing numerous "S" shaped mounting blocks so that a user may attach these mounting blocks to all pictures and/or certificates and other items desired to be hung from the elongated wall mount block. Additionally, the "S" shaped mounting block may be utilized without attaching it to the back surface of the picture frame. In this arrangement the user would simply hang the "S" shaped mounting block from any desired location along the elongated wall mount block and hook an item onto the "S" shaped mounting block by placing a hook 36 as illustrated in FIG. 5.

Figure 3:
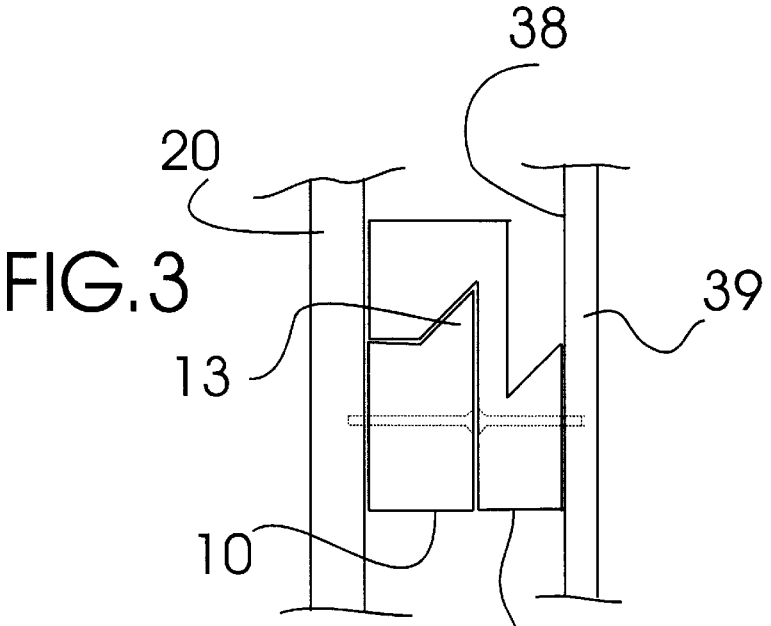
FIG. 3 is a side view of the elongated wall mount block with the S-shaped mounting block attached to a back surface of a picture frame and with the picture hung on the elongated block.
Figure 4:
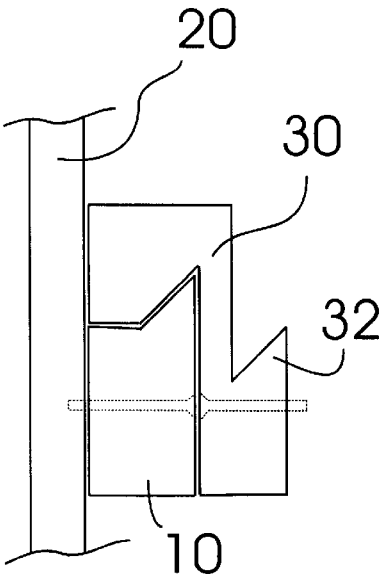
FIG. 4 is a side view of an elongated wall mount block and a stylized "S" shaped mounting block without any attachment.

FIG. 4 illustrated a cross section of an elongated wall mount block with an "S" shaped mounting block attached to it without a picture or item hung from the front peak 32. FIG. 5 illustrates the identical arrangement of FIG. 4 however an item 37 is hung from peak member 32. Referring to FIG. 3 which illustrates a normal arrangement of a picture with the "S" shaped mounting member attached to a back surface 38 of a picture frame 39. In this arrangement the picture may be moved longitudinally along any portion of the elongated wall mount member. Furthermore the picture is positively retained on the elongated wall mount by the elongated peak portion 13.

As can be seen, the elongated wall mounting block and the numerous "S" shaped mounting members allows the user to mount and hang pictures of any desired location longitudinally along the elongated wall mount member.

It is noted that the embodiment of the Frame Support System described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A frame support system comprising:

a) an elongated wall mount block with numerous mounting apertures for mounting the elongated wall mount block to a wall of a house and further wherein the elongated wall mount block includes a base rectangular portion and a peak formed along an outside top edge extending the length of the elongated wall mount block and providing a location for retaining a portion of an S-shaped mounting block, and b) a number of the S-shaped mounting blocks, each of the S-shaped mounting blocks including a rectangular middle member with a front peak portion integrally formed as an extension of the rectangular middle member for providing an area to securely position a picture frame support cable of a picture to be hung, a rear retention groove formed between a top back portion of the rectangular middle member and a rectangular extension extending back and opposite in direction of the front peak, the retention groove providing a mating location for the elongated peak on the elongated wall mount block; each S-shaped mounting block including numerous mounting apertures extending through a lower portion of the S-shaped mounting block; the mounting apertures providing a mounting location for fasteners to pass through the S-shaped mounting block and into a back surface of a picture frame desired to be hung.

* * * * *